US009358693B1

(12) United States Patent
Berger

(10) Patent No.: US 9,358,693 B1
(45) Date of Patent: Jun. 7, 2016

(54) SHEARS

(71) Applicant: Eric T. Berger, Seattle, WA (US)

(72) Inventor: Eric T. Berger, Seattle, WA (US)

( * ) Notice: Subject to any disclaimer, the term of this patent is extended or adjusted under 35 U.S.C. 154(b) by 0 days.

(21) Appl. No.: 14/664,539

(22) Filed: Mar. 20, 2015

(51) Int. Cl.
*B26B 13/16* (2006.01)
*B26B 13/26* (2006.01)
*B26B 13/12* (2006.01)

(52) U.S. Cl.
CPC ..... *B26B 13/16* (2013.01); *B26B 13/12* (2013.01); *B26B 13/26* (2013.01)

(58) Field of Classification Search
CPC ..... B26B 13/26; B26B 13/16; B26B 13/12; A01G 3/025
USPC ..... 30/251, 189, 190, 261
See application file for complete search history.

(56) References Cited

U.S. PATENT DOCUMENTS

| | | | | | |
|---|---|---|---|---|---|
| 21,369 | A | * | 8/1858 | Roome | 30/251 |
| 25,140 | A | * | 8/1859 | Roome | 30/251 |
| 173,010 | A | * | 2/1876 | Humpheries | 30/251 |
| 192,426 | A | * | 6/1877 | Foltz et al. | 30/251 |
| 203,112 | A | * | 4/1878 | Broadbrooks | 74/1 R |
| 663,565 | A | * | 12/1900 | Fisher | 30/261 |
| 883,457 | A | | 3/1908 | Geis | |
| 942,043 | A | | 11/1909 | Searight | |
| 1,012,289 | A | | 12/1911 | Stich | |
| 2,084,633 | A | | 6/1937 | Erickson | |
| 2,442,424 | A | | 6/1948 | McGary et al. | |
| 2,528,816 | A | | 11/1950 | Boyer | |
| 2,607,114 | A | * | 8/1952 | Keiser, Jr. | A01G 3/065 30/248 |
| 2,689,401 | A | * | 9/1954 | Kalish | 30/248 |
| 2,744,323 | A | * | 5/1956 | Kuhlman | 30/251 |
| 3,296,697 | A | * | 1/1967 | Hedstrom | 30/248 |
| 3,486,227 | A | | 12/1969 | Somervell | |
| 3,572,192 | A | | 3/1971 | Juras | |
| 3,791,013 | A | | 2/1974 | Rogers | |
| 3,834,022 | A | * | 9/1974 | Students | B26B 13/28 30/261 |
| 4,525,929 | A | | 7/1985 | Brophy, Sr. et al. | |
| 5,014,433 | A | * | 5/1991 | Tepic | B26B 13/26 30/248 |
| 5,355,585 | A | * | 10/1994 | Tepic | 30/260 |
| 5,918,371 | A | * | 7/1999 | Herrmann et al. | 30/260 |
| 6,000,138 | A | * | 12/1999 | Bornancini | B26B 13/20 30/232 |
| 6,685,716 | B1 | | 2/2004 | Flaherty et al. | |
| 6,752,054 | B2 | | 6/2004 | Knight | |
| 2007/0101583 | A1 | * | 5/2007 | Tsai | 30/244 |
| 2009/0223059 | A1 | * | 9/2009 | Yu Chen | 30/92 |
| 2012/0030951 | A1 | * | 2/2012 | Seloff | A01G 3/0251 30/252 |
| 2013/0031786 | A1 | * | 2/2013 | Wang | 30/251 |

FOREIGN PATENT DOCUMENTS

| | | | |
|---|---|---|---|
| AT | 404003 | B | 7/1998 |
| CH | 652637 | A5 | 11/1985 |
| FR | 2837126 | A1 | 9/2003 |
| GB | 1522144 | A | 8/1978 |

* cited by examiner

*Primary Examiner* — Laura M Lee
(74) *Attorney, Agent, or Firm* — Knobbe, Martens, Olson & Bear, LLP

(57) ABSTRACT

Shears for cutting hair or other material can include a handle assembly. The handle assembly can have a first handle and a second handle. The handle assembly can be connected to a blade assembly via a joint assembly. The joint assembly can be configured to bias the blade assembly to an opened configuration. The joint assembly can connect the blades to the handle assembly such that, as the second handle is moved away from the first handle in a first direction, the second blade is moved away from the first blade in the same first direction.

10 Claims, 7 Drawing Sheets

SHEARS

BACKGROUND OF THE INVENTIONS

1. Technical Field

The present disclosure generally relates to shears for cutting hair and other materials.

2. Description of the Related Art

Various devices and methods are used to cut hair, paper, and other cuttable material or structures. In many cases, "X" shaped shears are used having a pair of handles attached to a pair of blades via a hinge point. Such shears often comprise two handle-blade pieces attached to and crossing each other at the hinge point.

SUMMARY OF THE INVENTIONS

In some embodiments, shears include a handle assembly. The handle assembly can include a first handle having a base end and a free end. In some embodiments, the handle assembly includes a second handle having a base end and a free end movable toward and away from the free end of the first handle. The shears can include a first blade having a base end and a free end. In some embodiments, the shears include a second blade having a base end and a free end moveable toward and away from the free end of the first blade. The shears can include a joint assembly connecting the first blade and second blade to the handle assembly. The joint assembly can include a pivot plate. In some embodiments, the joint assembly includes a first pivot rotatably connecting the pivot plate to the base end of the second handle. In some cases, the joint assembly includes a second pivot rotatably connecting the pivot plate to the base end of the first handle. The joint assembly can include a third pivot rotatably connecting the base end of the second handle to the base end of the second blade. In some cases, the joint assembly includes a fourth pivot rotatably connecting the base end of the first blade to the base end of the second blade. In some embodiments, the joint assembly includes a biasing assembly installed on one of the first, second, third, or fourth pivots. The biasing assembly can be configured to bias the free end of the first blade away from the free end of the second blade. The biasing assembly can include a spring configured to generate a biasing force when the free ends of the first and second blades are moved toward each other. In some embodiments, the biasing force biases the free ends of the first and second blades away from each other.

In some embodiments, movement of the free end of the second handle away from the free end of the first handle moves the free end of the second blade away from free end of the first blade. In some embodiments, the upward movement of the free end of the second handle away from the free end of the first handle moves the free end of the second blade upward away from the free end of the first blade.

In some cases, the biasing assembly comprises an axis of rotation. The biasing assembly can include a first frame portion having a base portion and a spring housing portion extending from the base portion. In some embodiments, the biasing assembly includes a second frame portion having a base portion and a mating post extending from the base portion along the axis of rotation and into the spring housing portion of the first frame portion when the second frame portion is mated with the first frame portion, the second frame portion configured to rotate with respect to the first frame portion about the axis of rotation. In some cases, the biasing assembly includes a coil spring housed in the spring housing portion. The coil spring can have a center portion fixedly connected to the mating post and an outer portion extending out from the spring housing portion. In some embodiments, the outer portion of the coil spring is inhibited from rotating about the axis of rotation in at least one direction with respect to the first frame portion. In some cases, movement of the free end of the second blade away from the free end of the first blade is configured to rotate the second frame portion with respect to the first frame portion about the axis or rotation.

In some embodiments, the third pivot is configured to move toward the second pivot when the free end of the second blade is moved away from the free end of the first blade.

According to some variants, the biasing assembly includes a fastener inserted through one of the first, second, third, and fourth pivots. The biasing assembly can include a spring connection structure on the second blade between the base end and the free end of the second blade. In some cases, the biasing assembly includes a protrusion on the first blade between the free end of the first blade and the base end of the first blade. The biasing assembly can include a leaf spring having a first end connected to the fastener, a second end connected to the spring connection structure, and a flex point between the first and second ends of the leaf spring. The leaf spring can be configured to bend about the protrusion when the free end of the second blade is moved toward the free end of the second blade. In some embodiments, bending of the leaf spring biases the free end of the second blade away from the free end of the first blade.

In some embodiments, the spring connection structure is a protrusion extending from the second blade between the first and second blades. In some embodiments, the second blade includes a spring cavity in a side of the second blade opposing the first blade, and wherein the leaf spring and spring connection structure are positioned at least partially within the spring cavity.

According to some variants, shears can be configured to transition between a closed position and an opened position. The shears can include a first handle. In some embodiments, the shears include a second handle connected to the first handle. The shears can include a first blade connected to the first handle and to the second handle. The first blade can be configured to remain stationary with respect to the first handle when the shears transition between the closed position and the opened position. In some embodiments, the shears include a second blade connected to the first blade, to the first handle, and to the second handle. The second blade can be configured to move relative to the second handle when the shears transition between the closed position and the opened position. In some cases, the shears include a biasing assembly installed at a connection point between two of the first handle, the second handle, the first blade, and the second blade. The biasing assembly can be configured to bias the shears to the opened position. In some embodiments, the biasing assembly includes a spring configured to generate a biasing force when the shears are in the closed position.

In some embodiments, the biasing assembly comprises a spring connection structure on the second blade. The biasing assembly can include a protrusion on the first blade. In some cases, the biasing assembly includes a leaf spring. The leaf spring can have a first end connected to a connection point between two of the first handle, the second handle, the first blade, and the second blade; a second end connected to the spring connection structure; and a flex point between the first and second ends of the leaf spring. The leaf spring can be configured to bend about the protrusion when the shears transition between the opened position and the closed position. In some embodiments, bending of the leaf spring biases the shears to the opened position.

In some embodiments, the shears include a pivot plate rotatably connected to two of the first blade, the second blade, the first handle, and the second handle. In some embodiments, the pivot plate is rotatably connected to the first handle and to the second handle.

According to some variants, the biasing assembly comprises an axis of rotation. The biasing assembly can include a first frame portion having a base portion and a spring housing portion extending from the base portion. In some cases, the biasing assembly includes a second frame portion having a base portion and a mating post extending from the base portion along the axis of rotation and into the spring housing portion of the first frame portion when the second frame portion is mated with the first frame portion. The second frame portion can be configured to rotate with respect to the first frame portion about the axis of rotation. In some embodiments, the biasing assembly includes a coil spring housed in the spring housing portion. The coil spring can have a center portion fixedly connected to the mating post and an outer portion extending out from the spring housing portion. In some embodiments, the outer portion of the coil spring is inhibited from rotating about the axis of rotation in at least one direction with respect to the first frame portion. In some cases, movement of the shears between the opened configuration and the closed configuration is configured to rotate the second frame portion with respect to the first frame portion about the axis or rotation.

In some embodiments, each of the first frame portion and the second frame portion include a blade-engaging feature configured to rotational lock the first and second frame portions to the first and second blades, respectively. In some cases, each of the first frame portion and the second frame portion include a blade-engaging feature configured to rotational lock the first and second frame portions to the second and first blades, respectively.

In some cases, the shears comprise a first pivot where the pivot plate connects to the first handle; and a second pivot where the first blade connects to the second blade. In some embodiments, a distance between the first pivot and the second pivot remains constant as the shears transition between the closed position and the opened position.

According so certain variants, shears can be configured to transition between a closed position and an opened position. The shears can include a first handle and a second handle. In some embodiments, the shears include a first blade forming a monolithic part with the first handle and a second blade connected to the first blade and to the first handle. The second blade can be configured to move relative to the second handle when the shears transition between the closed position and the opened position. In some embodiments, the shears include a biasing assembly installed at a connection point between two of the first handle, the second handle, the first blade, and the second blade. The biasing assembly can be configured to bias the shears to the opened position.

In some embodiments, the shears include a pivot plate rotatably connected to the first handle and rotatably connected to the second handle. In some embodiments, the shears include a first pivot where the second blade rotatable connect to the second handle; and a second pivot where the pivot plate connects to the first handle. In some cases, the first pivot moves toward the second pivot when the shears transition from the closed position to the opened position. In some embodiments, the shears include a second biasing assembly installed at a connection point between two of the first handle, the second handle, the first blade, and the second blade.

BRIEF DESCRIPTION OF THE DRAWINGS

The present disclosure is described with reference to the accompanying drawings, in which like reference characters reference like elements, and wherein.

DETAILED DESCRIPTION OF THE EMBODIMENTS

Embodiments of the inventions will now be described with reference to the accompanying figures, wherein like numerals refer to like elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Figure 1:
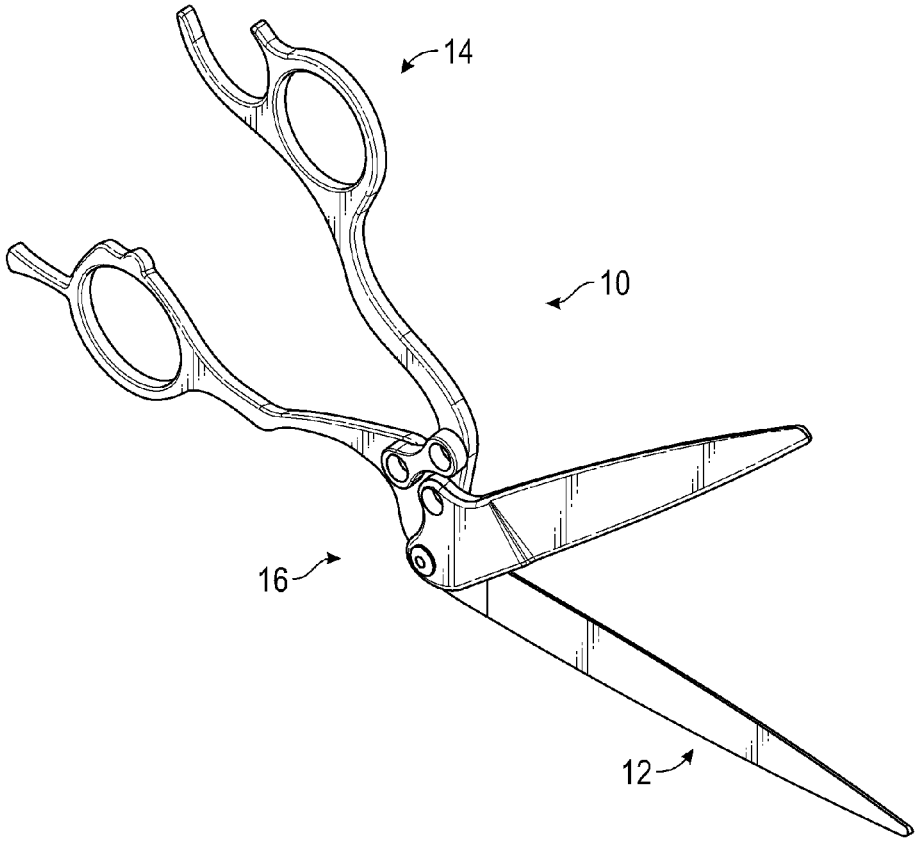
FIG. 1 is a perspective view of an embodiment of a set of shears.

As illustrated in FIG. 1, shears 10 can include a set of blades 12. The blades 12 can be configured to cut hair, bandages, paper, and/or other cuttable materials. The shears 10 can include a handle assembly 14. The handle assembly 14 can be configured to interface with the hand and/or fingers of a user to facilitate operation (e.g., cutting movement) of the blades 12. The handle assembly 14 can be operably connected to the blades 12 via a joint assembly 16. The joint assembly 16 can be configured to translate movement of the handle assembly 14 into movement of the blades 12. The movement translation performed by the joint assembly 16 can be performed in a consistent manner. For example, the joint assembly 16 can be configured to translate a first type of handle movement (e.g., "opening" the handle assembly 14) of the handle assembly 14 into a first type of blade movement (e.g., "opening" of the blades 12) of the blades 12, each time the handle assembly 14 is subject to the first type of handle movement.

Figure 2:
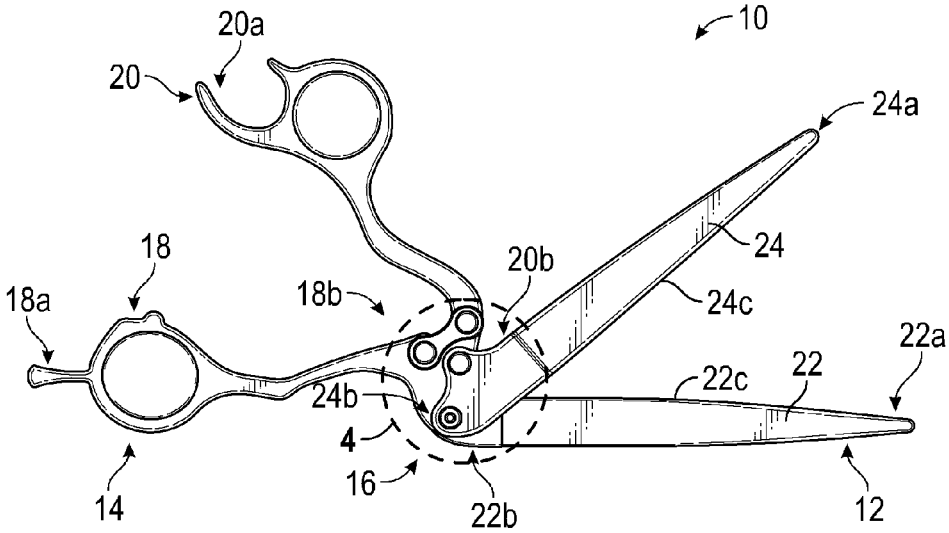
FIG. 2 is a left side plan view of the shears of FIG. 1 with the blades in an opened configuration.

Referring to FIG. 2, the handle assembly 14 can include a plurality of handles. For example, the handle assembly 14 can include a first handle 18. In some embodiments, the first handle 18 is configured to be operated by one or more fingers of a user. The handle assembly 14 can include a second handle 20. The second handle 20 can be configured to be operated by a thumb of the user. In some embodiments, the first and/or second handles 18, 20 can be configured to move toward and away from each other during operation of the shears 10. For example, a free end 20*a* of the second handle 20 can be configured to move toward and away from a free end 18*a* of the first handle 18. In some embodiments, a base end 20*b* of the second handle 20 is configured to remain fixed in position relative to a base end 18*b* of the first handle 18. In some embodiments, as illustrated in FIGS. 2 and 3, the base end 20*b* of the second handle 20 moves a short distance (e.g., as compared to movement of the free end 20*a*) with respect to the base end 18*b* of the first handle 18 when the free ends 18*a*, 20*a* of the handles 18, 20 are moved toward and away from each other.

In some embodiments, the set of blades 12 can include a first blade 22 and a second blade 24. One or more of the first blade 22 and the second blade 24 can be mechanically linked to one or more of the handles 18, 20 such that movement of the linked handle moves the linked blade. For example, the first blade 22 can be mechanically linked to the first handle 18. In some embodiments, one of the blades 22, 24 is monolithic with one of the handles 18, 20 while the other blade 22, 24 is separated from the other handle 18, 20. In some embodiments, the first blade 22 and first handle 18 form a monolithic part. The second handle 20 can be mechanically linked to the second blade 24. In some embodiments, the second handle 20 is separate from, but associated with the second blade 24. One of the handles 18, 20 can be formed as a monolithic part with one of the blades 22, 24 and be attached to the other handle 18, 20 and other blade 22, 24 via one or more connections (e.g., hinged connections). In some embodiments, one of the two handles 18, 20 is separate from the blades 22, 24 but pivotably connected to one or both of the blades 22, 24, while the blade 22, 24 to which the one of the two handles 18, 20 is pivotably connected to the other blade 18, 20 and the other of the two handles is linked to the other blade 18, 20. For example, the first handle 18 can be separated from the first and second blades 22, 24, but pivotably connected to the first blade 22. The first blade 22 can be pivotably connected to the second blade 24 and the second handle 20 can be linked (e.g., monolithic with) to the second blade 24.

Figure 3:
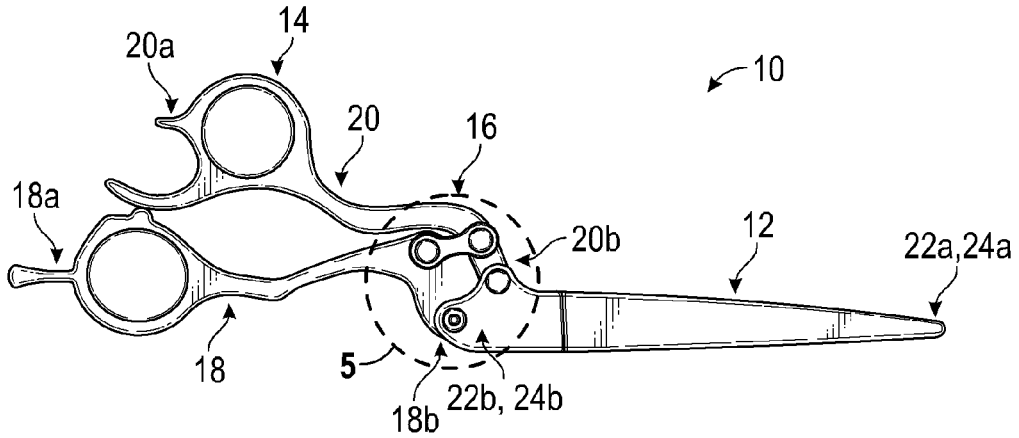
FIG. 3 is a left side plan view of the shears of FIG. 1 with the blades in a closed configuration.

In some embodiments, movement of the second handle 20 toward the first handle 18 moves the second blade 24 toward the first blade 22 (e.g., toward a closed position, as illustrated in FIG. 3). As illustrated in the frame of reference of both FIGS. 2 and 3, the second handle 20 and the second blade 24, when in the opened position, can be positioned such that a majority of the second handle 20 and the second blade 24 are positioned on the same side of (e.g., vertically higher or above) the first handle 18 and the first blade 22, respectively.

As illustrated in FIG. 3, the shears 10 can be transitioned to a closed position from the opened position illustrated in FIG. 2. For example, movement of the second handle 20 toward the first handle 18 can move a free end 24*a* of the second blade 24 in an arcuate path toward a free end 22*a* of the first blade 22 and into the closed position. In the closed position one or more cutting edges will move beyond each other and the blades will overlap to at least some degree when in the closed position. In some embodiments, a base end 24*b* of the second blade 24 is laterally fixed (e.g., in the plane of FIGS. 2-5) in position with respect to a base end 22*b* of the first blade 22. In some embodiments, the base end 22*b* of the first blade 22 moves a short distance (e.g., as compared to a distance traveled by the free end 22*a* of the first blade 22) with respect to the base end 24*b* of the second blade 24 as the blades 12 transition between closed and opened positions.

The blades 12 can be oriented such that the free ends 22*a*, 24*a* are positioned closer (e.g., into and out of the page of FIGS. 2 and 3) to each other than the base ends 22*b*, 24*b* of the blades 22, 24. Positioning the free ends 22*a*, 24*a* closer together than the base ends 22*b*, 24*b* of the blades 22, 24 can maintain contact between the portions of the cutting edges 22*c*, 24*c* which overlap at a given position between the opened and closed positions. For example, the cutting edges 22*c*, 24*c* of the free ends 22*a*, 24*a* can contact when the blades 12 are in the closed position, wherein the cutting edges 22*c*, 24*c* of each blade 22, 24 contact each other between the free and base ends when the blades 12 are between the closed position of FIG. 3 and the opened position of FIG. 2.

Figure 4:
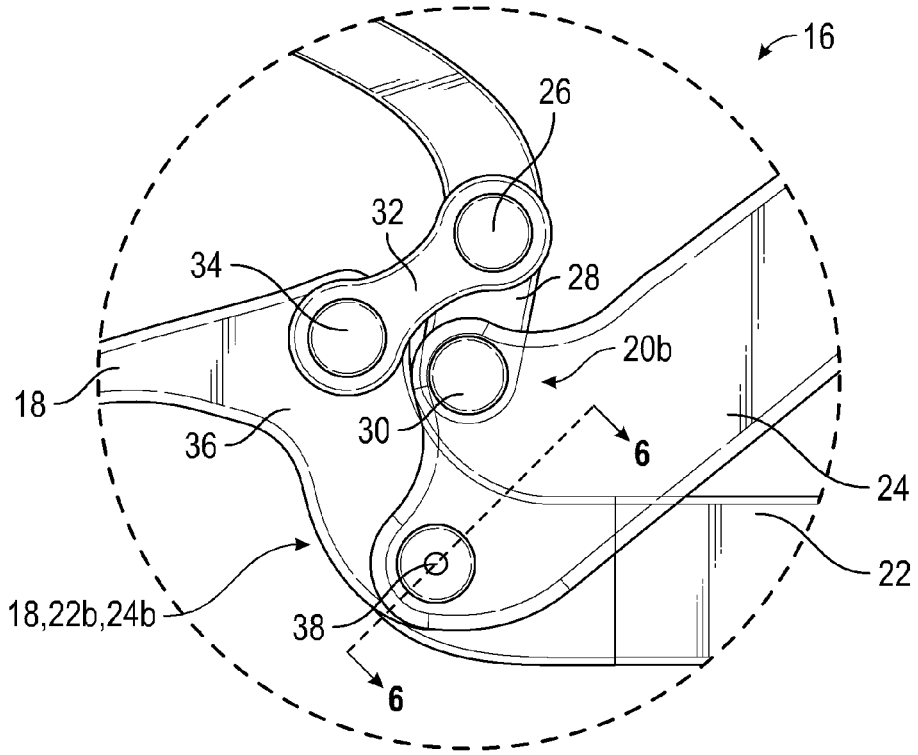
FIG. 4 is an enlarged view of the portion of the shears of FIG. 2 encircled by the line 4-4.

Referring to FIG. 4, the joint assembly 16 can include one or more pivots. For example, the joint assembly 16 can include a first pivot 26 about which the second handle 20 can rotate. The first pivot 26 can be positioned at or near the base end 20*b* of the second handle 20. In some embodiments, a base portion 28 of the second handle 20 is connected to a second pivot 30. The second pivot 30 can be positioned between the first pivot 20 and the base end 20*b* of the second handle 20. In some embodiments, the second pivot 30 rotatably couples the second handle 20 to the second blade 24 (e.g., at or near the base ends 20*b*, 24*b* of the second handle 20 and second blade 24).

In some embodiments, the first pivot 26 rotatably couples the second handle 20 to the first end of a pivot plate 32. A second end of the pivot plate 32 can be rotatably connected to a third pivot 34. The third pivot 34 can rotatably couple the pivot plate 32 to a base portion 36 of the first handle 18.

Figure 5:
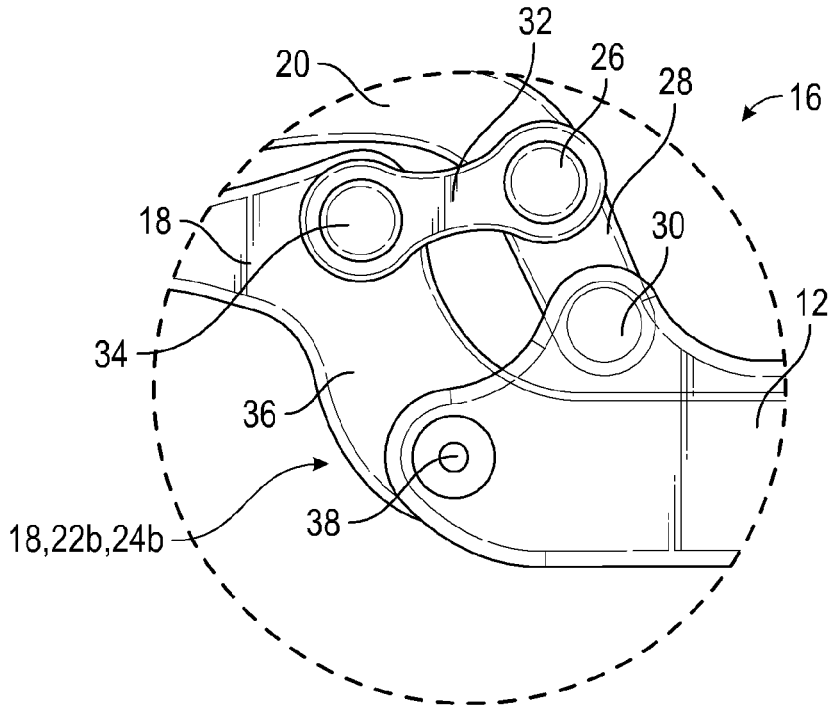
FIG. 5 is an enlarged view of the portion of the shears of FIG. 3 encircled by the line 5-5.
Figure 6:
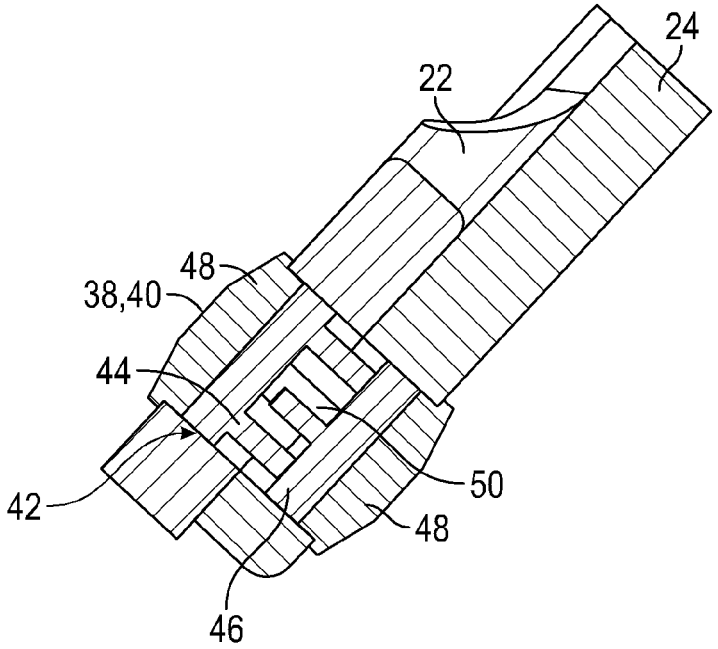
FIG. 6 is a cross-sectional view of a spring assembly as viewed along the cut plane 6-6 of FIG. 4.

As illustrated in FIGS. 4 and 5, the joint assembly 16 can include a fourth pivot 38. The fourth pivot 38 can rotatably couple the base end 22*b* of the first blade 22 to the base end 24*b* of the second blade 24. In some embodiments, the fourth pivot 38 couples the base end 22*b* of the first blade 22 to the base end 18*b* of the first handle 18. In some embodiments, the fourth pivot 38 couples the base end 24*b* of the second blade 24 to the base end 18*b* of the first handle 18.

According to some embodiments, transition of the blades 12 from a closed position (FIG. 3) to an opened position (FIG. 2) can be initiated through movement of the free end 20*a* of the second handle 20 away from the free end 18*a* of the first handle 18. Such movement can rotate the second handle 20 in a clockwise direction (e.g., in the frame of reference of FIGS. 4 and 5) with respect to the first pivot 26. In some cases, movement of the free end 20*a* of the second handle 20 away from the free end 18*a* of the first handle 18 can rotate the second handle 20 in a clockwise direction about the second pivot 30. In some embodiments, clockwise rotation of the second handle 20 about both the first and second pivots 26, 30 rotates the base portion 28 of the second handle 20 between the first and second pivots 26, 20 in a clockwise direction. As illustrated in FIGS. 4 and 5, clockwise rotation of the second handle 20 about both the first and second pivots 26, 30 can translate the first and second pivots 26, 30 upward and leftward in the frame of reference of FIGS. 4 and 5. Upward and leftward movement of the second pivot 30 can rotate the second blade 24 about the fourth pivot 38 and can move the free end 24*a* of the second blade 24 away from the free end 22*a* of the first blade 22. In some embodiments, upward and/or leftward movement of the first pivot 26 can rotate the pivot plate 32 about the third pivot 34 in a counterclockwise direction in the frame of reference of FIGS. 4 and 5. Transition of the blades 12 from the opened position to the closed position can initiate relative motion of the components of the shears 20 in directions opposite of those described above with respect to transition of the blades 12 from the closed position to the opened position. In some embodiments, transition of the blades 12 between the closed and opened positions can be performed without movement of the first blade 22 or of the first handle 18 (e.g., when the first blade 22 and first handle 18 form a monolithic part). In some embodiments, transition of the blades 12 between the closed and opened positions also can be performed without relative movement between the first blade 22 and the first handle 18 and, in addition, without movement of the first blade 22 and the first handle 18.

In some embodiments, the shears 10 can include a biasing member. The biasing member can be configured to bias the blades 12 toward the opened position. In some embodiments, the biasing member biases the blades toward the closed position. For example, one or more of the pivots can include a biasing assembly. In some embodiments, the biasing assembly acts against two or more of the components of the shears 10 which are moveable relative to each other. For example, the biasing assembly can act against the second handle 20 and the first handle 18, against the first blade 22 and the second blade 24, against the second blade 24 and the second handle 20, against the first blade 22 and the first handle 18, against the pivot member 32 and the second handle 20, against the pivot member and the first handle 18, against the first blade 22 and the second handle 22, against the first handle 18 and the second blade 24, against the first blade 22 and the pivot member 32, and/or against the second blade 24 and the pivot member 32. The one or more biasing assemblies can include a spring (e.g., a coil spring, leaf spring, tension spring, compression spring, etc.) configured to rotationally bias one or more components connected to the pivot(s) which include biasing assemblies.

As illustrated in FIGS. 6-9, the joint assembly 16 can include a biasing assembly 40. The biasing assembly 40 can include a housing 42. The housing 42 can include a first frame portion 44. In some embodiments, the housing 42 includes a second frame portion 46. The second frame portion 46 can be configured to interface and/or interlock with the first frame portion 44. The first and second frame portions 44, 46 can be configured to rotate (e.g., about an axis of rotation 47, illustrated in FIG. 7) with respect to each other. In some embodiments, the first and second frame portions 44, 46 are rotationally fixed with respect to each other.

In some embodiments, the shears 10 include one or more caps 48 positioned adjacent the housing 42. The one or more caps 48 can be configured and positioned to reduce the likelihood that the housing 42 or some other component of the biasing assembly 40 detaches or decouples from the shears 10. In some embodiments, the one or more caps 48 reduce the likelihood that dirt, hair, or other debris gain access to the biasing assembly 40.

A spring can be positioned at least partially within the housing 42. For example, a coil spring 50 can be positioned at least partially within the housing 42. The coil spring 50 can include at least one coupling portion configured to couple with a portion of one or more of the first and second frame portions 44, 46. For example, the coil spring 50 can include a first coupling portion configured to couple with the first frame portion 44 and a second coupling portion configured to couple with the second frame portion 46. In some embodiments, the first coupling portion of the coil spring 50 is rotationally fixed to or limited by (e.g., with respect to the axis of rotation 47 of the biasing assembly) the first frame portion 44 during use of the shears 10. In some embodiments, the second coupling portion of the coil spring 50 is rotationally fixed to or limited by the second frame portion 46 during use of the shears 10.

In some embodiments, the first coupling portion is an outer portion 52 of the coil spring 50. The outer portion 52 of the coil spring 50 can comprise one end of the spring material of the coil spring 50. The first frame portion 44, or some portion thereof, can limit or prevent movement of the outer portion 52 of the coil spring 50 in at least one direction about the axis of rotation 47 with respect to the first frame portion 44.

In some embodiments, the second coupling portion is a central portion 54 of the coil spring 50. The central portion 54 can comprise one end of the spring material of the coil spring 50. In some embodiments, the central portion 54 is configured to mate with a mating portion of one or more of the first and second frame portions 44, 46. For example, the central portion 54 can mate with a mating structure of the second frame portion 46. The mating structure of the second frame portion 46 can limit or prevent movement of the central portion 54 of the coil spring 50 in at least one direction about the axis of rotation 47 with respect to the first frame portion 44.

Figure 7:
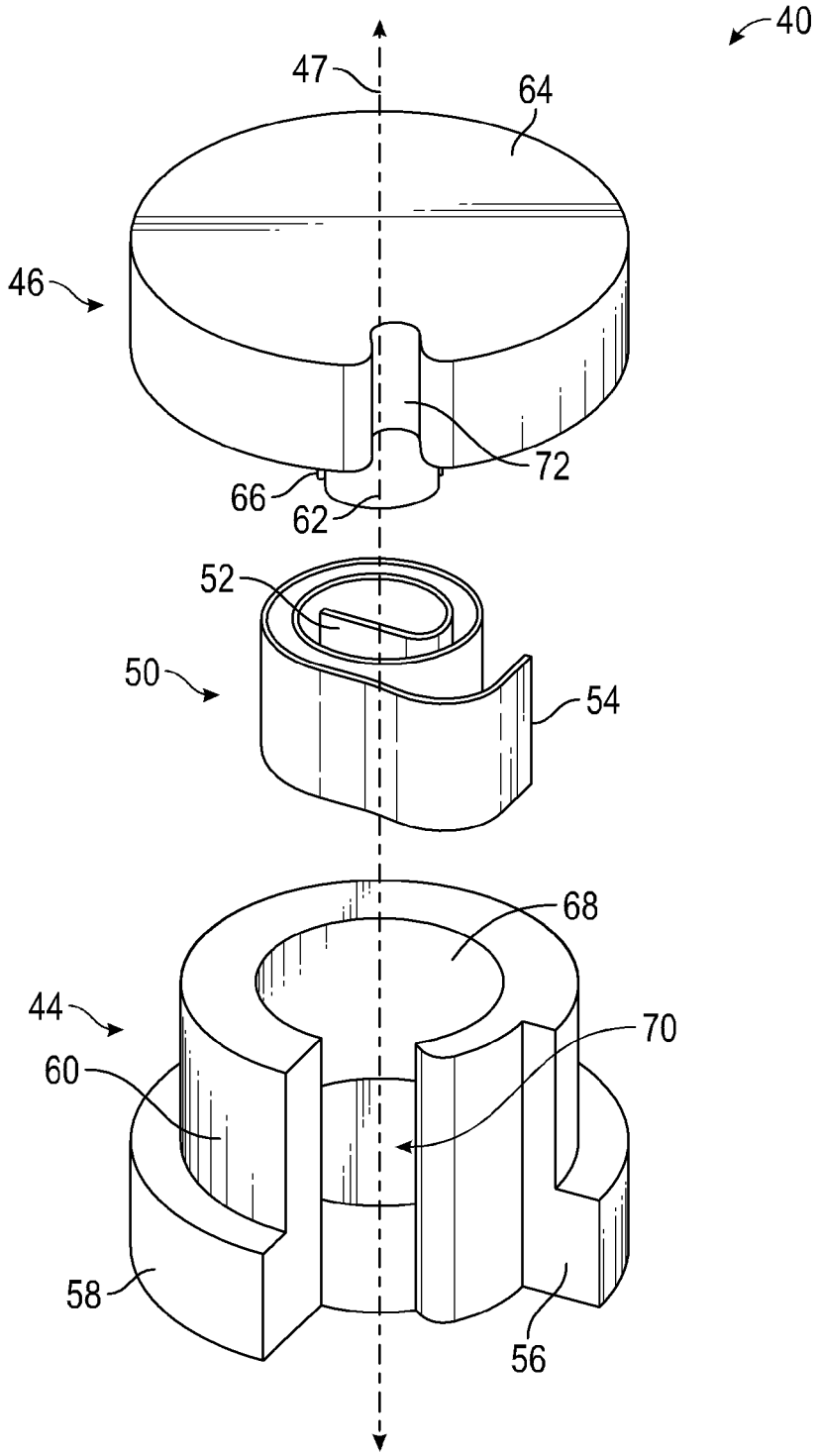
FIG. 7 is an exploded view of the spring assembly of FIG. 6.

As illustrated in FIG. 7, the first frame portion 44 can include a wall 56. The wall 56 can extend from a base portion 58 of the first frame portion 44 through a spring housing portion 60 of the first frame portion 44. In some embodiments, the base portion 58 has a larger diameter/cross-sectional area than the spring housing portion 60. The wall 56 can be configured to abut the outer portion 52 of the coil spring 50 to limit circumferential movement of the outer portion 52 in at least one direction about the axis of rotation 47. In some embodiments, the spring housing portion 60 can include one or more notches, ridges, protrusions, or other structures configured to connect with (e.g., adhere to, mechanically link with, crimp to) the outer portion 52 of the spring 50.

The second frame portion 46 can include a mating post 62. The mating post 62 can extend from a base portion 64 of the second frame portion 46 toward the first frame portion 44. The mating post 62 can include a slit 66 or recess configured to receive the central portion 54 of the coil spring 50. Coupling between the central portion 54 of the coil spring 50 and the slit 66 can limit or prevent rotation of the central portion 54 about the axis of rotation 47 with respect to the second frame portion 46.

Figure 8:
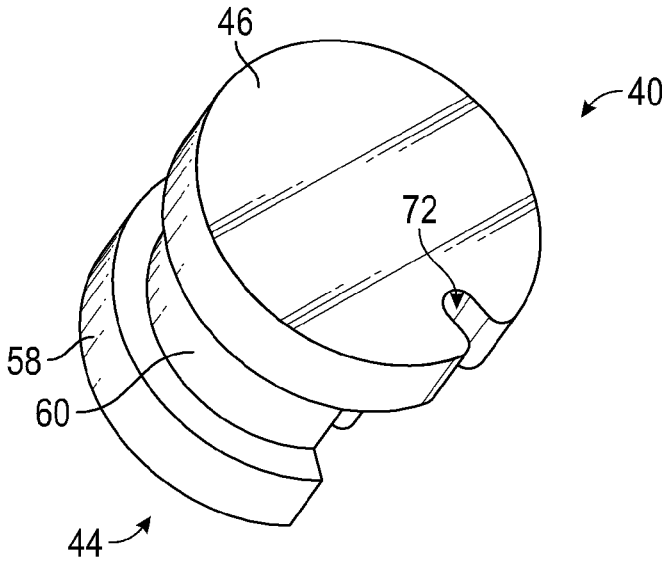
FIG. 8 is a top perspective view of the spring assembly of FIG. 6.
Figure 9:
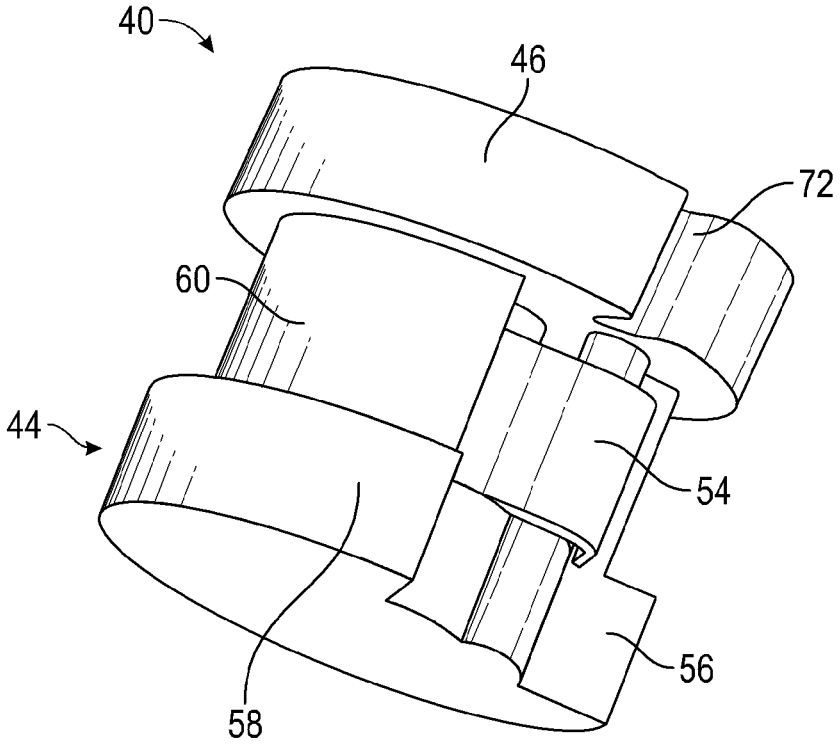
FIG. 9 is a bottom perspective view of the spring assembly of FIG. 6.

As illustrated in FIGS. 7-9, the coil spring 50 can be positioned within a cavity 68 at least partially defined by walls of the spring housing portion 60 of the first frame portion 44. The outer portion 54 of the coil spring 50 can extend outward from the cavity 68 through an opening 70 in the walls of the spring housing portion 60. In some embodiments, positioning at least a portion of the coil spring 50 within a cavity (e.g., the cavity 68) can reduce the likelihood that debris (e.g., hair, dirt) access the coil spring 50.

One or both of the first and second frame portions 44, 46 can include an alignment structure. The alignment structure can be configured to rotationally align one or more of the frame portions 44, 46 about the axis of rotation 47 with respect to one of the blades 12. In some embodiments, the alignment structure is a notch, a protrusion, a knob or some other structure. For example, the second frame portion 46 can include a notch 72 configured to engage with a portion of the second blade 24. The first frame portion 44 can include an alignment structure configured to engage with a portion of the first blade 22.

In some embodiments, the biasing assembly 40 can bias the shears 10 to an opened position. The biasing assembly 40 can be configured such that transition of the shears 10 from an opened position to the closed position of FIG. 3 introduces stress to the coil sprint 50. For example, as discussed above, transition of the shears 10 to the closed position can rotate the second blade 24 in a clockwise direction (in the frame of reference of FIGS. 2-5) about the fourth pivot 38. In some cases, the biasing structure 40 is installed in the fourth pivot 38. In some such embodiments, clockwise rotation of the second blade 24 about the fourth pivot can rotate the second housing portion 46 in the clockwise direction. Clockwise rotation of the second housing portion 46 can rotate the central portion 54 of the coil spring 50. In some embodiments, clockwise rotation of the central portion 54 of the coil spring 50 can compress the outer portion 52 of the coil spring 50 against the wall 56 of the first frame portion 44. Compression of the outer portion 52 (e.g., and/or corresponding stresses introduced to the remainder of the spring 50) can bias the second blade 24 away from the closed position and toward an opened position. In some embodiments, the outer portion 52 is connected to a portion of the spring housing portion 60, as described above. In some such embodiments, clockwise rotation of the central portion 54 of the spring 50 introduces extension stress to the coil spring 50 (e.g., the outer portion 52). Extension stresses in the coil spring 50 can bias the blades 12 to the opened position.

Figure 10:
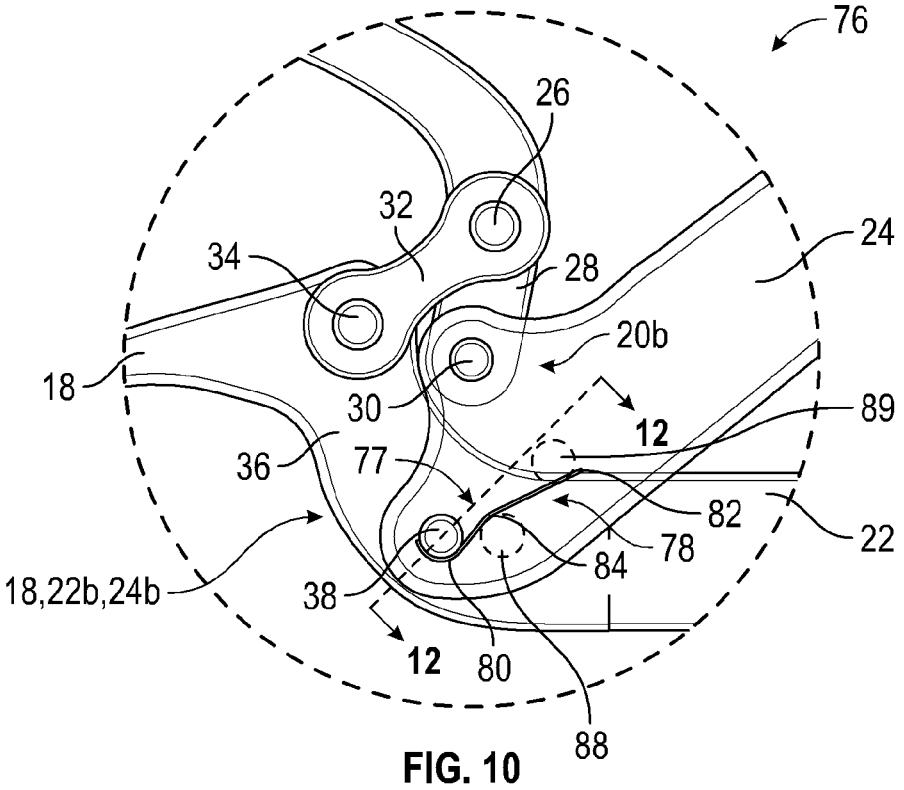
FIG. 10 is an enlarged view of an embodiment of shears using a leaf spring assembly, wherein the blades are in an opened configuration.
Figure 11:
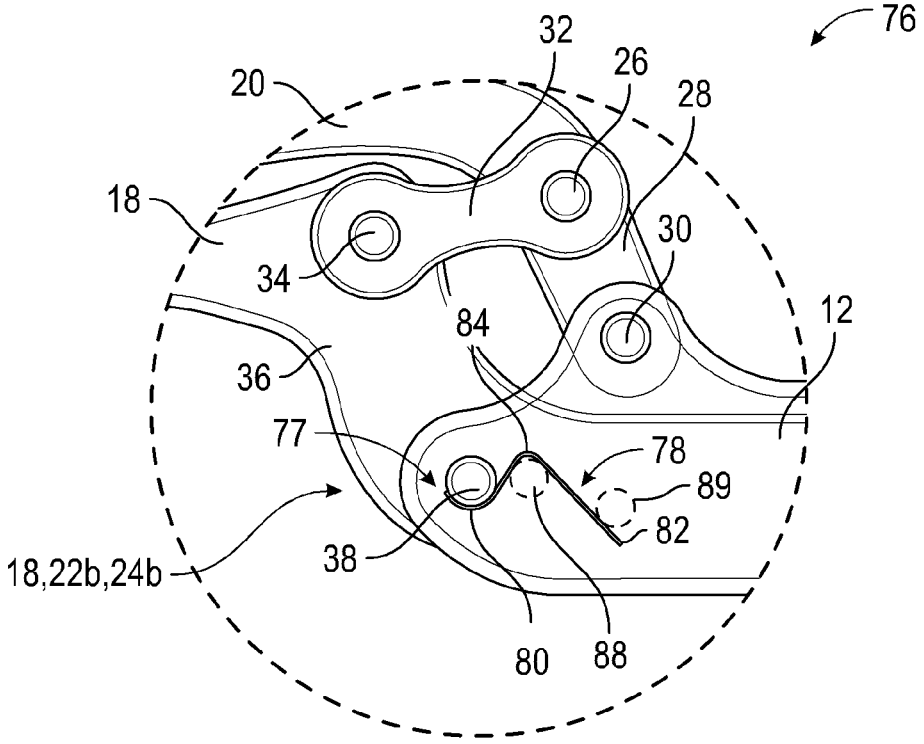
FIG. 11 is an enlarged view of an embodiment of the shears of FIG. 10, wherein the blades are in the closed configuration.
Figure 12:
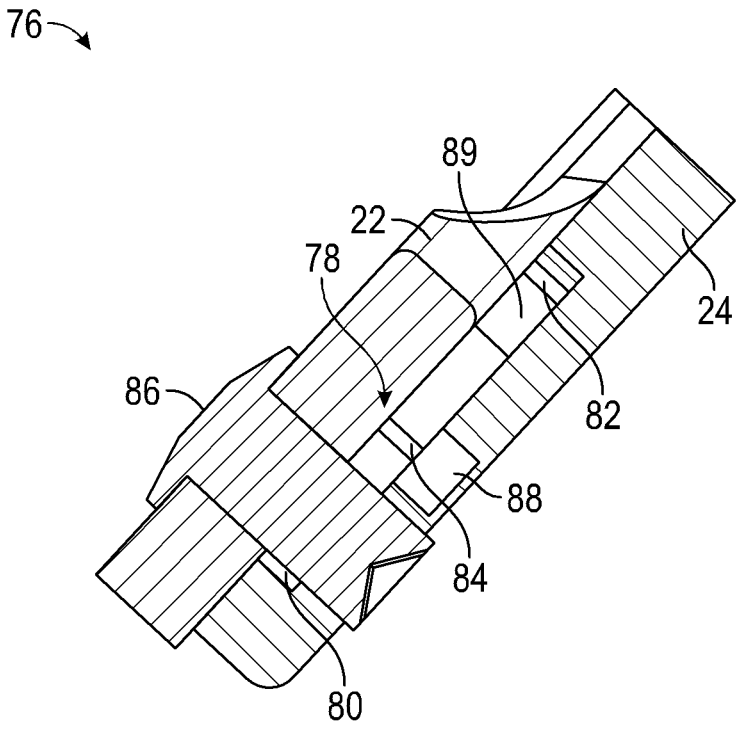
FIG. 12 is a cross-sectional view of the spring assembly of FIG. 10, as viewed along the cut plane 12-12 of FIG. 10.

As illustrated in FIGS. 10-12, a joint assembly 76 can include many of the same components, designated by the same reference numbers, as the joint assembly 16. The joint assembly 76 can include a biasing assembly 77. The biasing assembly 77 can include a leaf spring 78. The leaf spring 78 can extend between a first end 80 and a second 82. The first end 80 of the leaf spring 78 can be connected to one of the pivots. For example, as illustrated, the first end 80 of the leaf spring 78 can be connected to the fourth pivot 38 (e.g., to a fastener 86 set in the fourth pivot 38). The fastener 86 can be, for example, a screw, a bolt, a rivet, or some other fastener. The second end 82 of the leaf spring 78 can be connected to a portion of one or more of the blades 12, handle assembly 14, and/or pivot plate 32. For example, the second end 82 of the leaf spring 78 can be connected to the second blade 24 (e.g., to a protrusion, recess, or other connection structure of the second blade 24). As illustrated in FIG. 10, the second end 82 of the leaf spring 78 can be connected to and/or contacted by a protrusion 89. The protrusion 89 can be connected to or formed as part of the second blade 24.

As illustrated in FIGS. 10 and 11, the leaf spring 78 can be configured to transition between a first configuration (FIG. 10) and a second configuration (FIG. 11) as the blades 12 are transitioned between an opened position and a closed position. For example, the leaf spring 78 can be configured to bend when the blades 12 transition from the opened to the closed position. The leaf spring 78 can be configured to bend about a flex point 84 of the spring 78. For example, the leaf spring 78 can contact a protrusion 88 or other structure connected to the first blade 22 about which the leaf spring 78 bends. Bending of the leaf spring 78 can introduce a biasing stress into the spring 78 which biases the blades 12 to the opened position. For example, bending of the leaf spring 78 can introduce stress to the flex point 84 of the spring 78 and bias the spring 78 to return to an unbent or less bent configuration.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. For example, the biasing assemblies 40, 77 can be positioned in or on the first, second, third, and/or fourth pivots 26, 30, 34, 38. In some cases, joint assemblies 16, 76 include more than one biasing assembly. Additionally, the skilled artisan will recognize that any of the above-described methods can be carried out using any appropriate apparatus. Further, the disclosure herein of any particular feature, aspect, method, property, characteristic, quality, attribute, element, or the like in connection with an embodiment can be used in all other embodiments set forth herein. For all of the embodiments described herein, the steps of the methods need not be performed sequentially. Thus, it is intended that the scope of the present inventions herein disclosed should not be limited by the particular disclosed embodiments described above.

What is claimed is:

1. Shears comprising:

a handle assembly having:

a first handle having a base end and a free end; and a second handle having a base end and a free end movable toward and away from the free end of the first handle;

a first blade having a base end and a free end;

a second blade having a base end and a free end moveable toward and away from the free end of the first blade; and a joint assembly connecting the first blade and second blade to the handle assembly, the joint assembly having:

a pivot plate;

a first pivot rotatably connecting the pivot plate to the base end of the second handle and located at an intersection of the pivot plate and the base end of the second handle;

a second pivot rotatably connecting the pivot plate to the base end of the first handle and located at an intersection of the pivot plate and the base end of the first handle;

a third pivot rotatably connecting the base end of the second handle to the base end of the second blade and located at an intersection of the base end of the second handle and the base end of the second blade;

a fourth pivot rotatably connecting the base end of the first blade to the base end of the second blade and located at an intersection of the base end of the first blade and a base end of the second blade; and a biasing assembly positioned in the fourth pivot and configured to bias the free end of the first blade away from the free end of the second blade, the biasing assembly comprising a spring configured to generate a biasing force when the free ends of the first and second blades are moved toward each other, the biasing force biasing the free ends of the first and second blades away from each other, the biasing assembly further comprising:

an axis of rotation;

a first frame portion having a base portion and a spring housing portion extending from the base portion; and a second frame portion having a base portion and a mating post extending from the base portion along the axis of rotation and into the spring housing portion of the first frame portion when the second frame portion is mated with the first frame portion, the second frame portion configured to rotate with respect to the first frame portion about the axis of rotation;

wherein the spring is a coil spring housed in the spring housing portion, the coil spring having a center portion fixedly connected to the mating post and an outer portion extending out from the spring housing portion;

wherein the outer portion of the coil spring is inhibited from rotating about the axis of rotation in at least one direction with respect to the first frame portion, wherein movement of the free end of the second blade away from the free end of the first blade is configured to rotate the second frame portion with respect to the first frame portion about the axis of rotation.

2. The shears of claim 1, wherein movement of the free end of the second handle away from the free end of the first handle moves the free end of the second blade away from free end of the first blade.

3. The shears of claim 1, wherein the upward movement of the free end of the second handle away from the free end of the first handle moves the free end of the second blade upward away from the free end of the first blade.

4. The shears of claim 1, wherein the third pivot is configured to move toward the second pivot when the free end of the second blade is moved away from the free end of the first blade.

5. Shears configured to transition between a closed position and an opened position, the shears comprising:

a first handle;

a second handle connected to the first handle;

a first blade connected to the first handle and to the second handle, the first blade configured to remain stationary with respect to the first handle when the shears transition between the closed position and the opened position;

a second blade connected to the first blade, to the first handle, and to the second handle, the second blade configured to move relative to the second handle when the shears transition between the closed position and the opened position; and a biasing assembly installed at a connection point between two of the first handle, the second handle, the first blade, and the second blade, the biasing assembly configured to bias the shears to the opened position, the biasing assembly comprising a spring configured to generate a biasing force when the shears are in the closed position, the biasing assembly comprising:

an axis of rotation;

a first frame portion having a base portion and a spring housing portion extending from the base portion;

a second frame portion having a base portion and a mating post extending from the base portion along the axis of rotation and into the spring housing portion of the first frame portion when the second frame portion is mated with the first frame portion, the second frame portion configured to rotate with respect to the first frame portion about the axis of rotation; and a coil spring housed in the spring housing portion, the coil spring having a center portion fixedly connected to the mating post and an outer portion extending out from the spring housing portion;

wherein the outer portion of the coil spring is inhibited from rotating about the axis of rotation in at least one direction with respect to the first frame portion, wherein movement of the shears between the opened configuration and the closed configuration is configured to rotate the second frame portion with respect to the first frame portion about the axis or rotation.

6. The shears of claim 5, comprising a pivot plate rotatably connected to two of the first blade, the second blade, the first handle, and the second handle.

7. The shears of claim 6, wherein the pivot plate is rotatably connected to the first handle and to the second handle.

8. The shears of claim 5, wherein each of the first frame portion and the second frame portion include a blade-engaging feature configured to rotational lock the first and second frame portions to the first and second blades, respectively.

9. The shears of claim 5, wherein each of the first frame portion and the second frame portion include a blade-engaging feature configured to rotational lock the first and second frame portions to the second and first blades, respectively.

10. The shears of claim 7, comprising:

a first pivot where the pivot plate connects to the first handle; and a second pivot where the first blade connects to the second blade;

wherein a distance between the first pivot and the second pivot remains constant as the shears transition between the closed position and the opened position.

* * * * *